US011981494B2

(12) United States Patent
Krieger et al.

(10) Patent No.: US 11,981,494 B2
(45) Date of Patent: May 14, 2024

(54) TRANSFER CANNULA

(71) Applicant: RPC Formatec GmbH, Mellrichstadt (DE)

(72) Inventors: Johannes Krieger, Mellrichstadt (DE); Markus Thau, Mellrichstadt (DE)

(73) Assignee: RPC Formatec GmbH, Mellrichstadt (DE)

( * ) Notice: Subject to any disclaimer, the term of this patent is extended or adjusted under 35 U.S.C. 154(b) by 292 days.

(21) Appl. No.: 17/613,180

(22) PCT Filed: May 29, 2020

(86) PCT No.: PCT/EP2020/064959
§ 371 (c)(1),
(2) Date: Nov. 22, 2021

(87) PCT Pub. No.: WO2020/239973
PCT Pub. Date: Dec. 3, 2020

(65) Prior Publication Data

US 2022/0315310 A1 Oct. 6, 2022

(30) Foreign Application Priority Data

May 29, 2019 (DE) ..... 10 2019 114 502.3
Aug. 14, 2019 (DE) ..... 10 2019 121 915.9

(51) Int. Cl.
*B65D 81/32* (2006.01)

(52) U.S. Cl.
CPC ..... *B65D 81/3211* (2013.01)

(58) Field of Classification Search
CPC ..... B65D 81/3211
(Continued)

(56) References Cited

U.S. PATENT DOCUMENTS 4,583,971 A * 4/1986 Bocquet ..... A61J 1/2089 604/82
4,898,209 A * 2/1990 Zbed ..... A61J 1/2089 137/614.04

(Continued)

FOREIGN PATENT DOCUMENTS

EP 0 409 056 A2 1/1991
WO 2012/143921 A1 10/2012

OTHER PUBLICATIONS

International Search Report of PCT/EP2020/064959, dated Oct. 19, 2020.

*Primary Examiner* — Timothy L Maust
(74) *Attorney, Agent, or Firm* — Collard & Roe, P.C.

(57) ABSTRACT

A transfer cannula for sterile transfer of fluids to powders or fluids to fluids from a first receptacle into a second receptacle has two tube sections running in the same direction which have different lengths in the longitudinal direction of the tube sections, the longer tube section terminating in an insertion tip. The tube sections are rigidly connected to a coupling wall surrounding the tube sections in a cylindrical manner. The coupling wall has a cutout which extends as far as an end edge of the coupling wall and in which, when viewed from the side, an insertion tip of each tube section is exposed. The coupling wall projects beyond the insertion tip in the direction of the longitudinal extent of the tube sections, and the cut-out widens in a corresponding V-shape at the end edge.

10 Claims, 9 Drawing Sheets

(58) Field of Classification Search
USPC ..... 604/413
See application file for complete search history.

(56) References Cited

U.S. PATENT DOCUMENTS 5,409,141 A * 4/1995 Kikuchi ..... A61J 1/2089 604/82
5,478,337 A * 12/1995 Okamoto ..... A61J 1/2089 604/82
5,879,345 A * 3/1999 Aneas ..... B65D 51/002 215/277
5,989,237 A * 11/1999 Fowles ..... F02D 11/10 604/413
6,537,263 B1 * 3/2003 Aneas ..... A61J 1/2089 604/416
6,582,415 B1 * 6/2003 Fowles ..... A61J 1/2089 137/614.04
6,948,522 B2 * 9/2005 Newbrough ..... A61J 1/2089 137/550
7,731,679 B2 6/2010 Tennican et al.
7,731,697 B2 * 6/2010 Porter ..... A61F 2/0077 604/174
8,545,476 B2 * 10/2013 Ariagno ..... A61J 1/2089 604/416
8,752,598 B2 * 6/2014 Denenburg ..... A61J 1/2096 141/105
8,900,212 B2 * 12/2014 Kubo ..... A61J 1/2096 604/413
10,285,907 B2 * 5/2019 David ..... A61J 1/2013
10,806,667 B2 * 10/2020 Denenburg ..... A61J 1/201
2015/0313797 A1 * 11/2015 Kubo ..... A61J 1/2096 604/413
2016/0151242 A1 * 6/2016 Mueller ..... A61J 1/2089 604/413

* cited by examiner

TRANSFER CANNULA

CROSS REFERENCE TO RELATED APPLICATIONS

This application is the National Stage of PCT/EP2020/064959 filed on May 29, 2020, which claims priority under 35 U.S.C. § 119 of German Application No. 10 2019 114 502.3 filed on May 29, 2019 and German Application No. 10 2019 121 915.9 filed on Aug. 14, 2019, the disclosure of which is incorporated by reference. The international application under PCT article 21(2) was not published in English.

TECHNICAL FIELD

The invention pertains to a transfer cannula for the sterile transfer of fluids to powders or fluids to fluids from a first receptacle into a second receptacle, wherein said transfer cannula has two parallel tube sections that have different lengths in the longitudinal direction of the tube sections, wherein the longer tube section terminates in an insertion tip, wherein the tube sections furthermore are designed to be rigidly connected to a coupling wall surrounding the tube sections in a cylindrical manner, wherein the coupling wall has, associated with each tip and arranged oppositely on both sides with respect to the longitudinal direction of the tube sections, a cutout that extends as far as a terminal edge of the coupling wall, and wherein an insertion tip of the tube sections is in a side view respectively exposed in said cutout.

The invention furthermore pertains to a transfer cannula for the sterile transfer of fluids to powders or fluids to fluids from a first receptacle into a second receptacle, wherein said transfer cannula has two parallel tube sections that have different lengths in the longitudinal direction of the tube sections, wherein the longer tube section terminates in an insertion tip, wherein the tube sections furthermore are surrounded by a coupling wall that extends radially outside of a retaining wall, and wherein the coupling wall is retained on the retaining wall so as to be displaceable in the longitudinal direction of the tube sections.

PRIOR ART

In practical applications, cannulas of this type are referred to as so-called transfer cannulas. They make it possible to realize a sterile transfer, e.g., of fluids to powders or fluids to fluids from a first receptacle into a second receptacle. In this case, the ends of the tube sections respectively penetrate a closure element of the respective receptacle, wherein said closure element is made, for example, of a rubber material. The closure element is penetrated by the insertion tip, which is respectively formed on one end of the tube sections, when the transfer cannula is attached.

In this case, the tube sections have different lengths along their longitudinal extent, particularly starting from a transverse plane that extends transverse to the longitudinal extent and in which both tube sections are in a corresponding sectional view illustrated in a full cross section, i.e. in a circumferentially closed manner. Starting from this point, the tube section having the insertion tip typically extends over a longer extending dimension than the other tube section.

Viewed in the opposite direction, the longer tube section having the insertion tip on one end may then be the shorter tube section starting from the aforementioned transverse plane.

As a result of this design and arrangement of two tube sections, an advantageous aeration or ventilation of the receptacles can be achieved in the course of the transfer.

A support on top of or on the receptacles can be respectively achieved by means of the coupling wall. In this case, the coupling wall may encompass the receptacle wall at least partially with respect to an extent in the direction of the longitudinal extent of the tube sections.

The cutouts provided in the coupling wall make it possible to grip the receptacle encompassed by the coupling wall, particularly for its removal.

A transfer cannula of this type is known, for example, from U.S. Pat. No. 6,948,522 B2.

A transfer cannula, in which the coupling wall is retained on a retaining wall so as to be displaceable in the longitudinal direction of the tube sections, furthermore is known, for example, from U.S. Pat. No. 5,879,345.

SUMMARY OF THE INVENTION

In light of the above-described prior art, an objective of the invention can be seen in advantageously enhancing a transfer cannula of the type in question, particularly in terms of its handling.

According to a first inventive idea, this objective is potentially attained with a transfer cannula, in which it is proposed that the coupling wall protrudes beyond the tip in the direction of the longitudinal extent of the tube sections, and that the cutout widens in a V-shaped manner at the terminal edge.

A potential solution may also be realized by providing two retaining walls, which with respect to a longitudinal extent of the tube sections extend in opposite directions starting from a central region and on which a coupling wall respectively is retained in a displaceable manner.

The coupling wall may be provided with such a length that the free terminal edge of the coupling wall is realized at a distance from the associated insertion tip of a tube section viewed in the direction of the longitudinal extent of the tube sections. This resulting longitudinal protrusion of the coupling wall beyond the insertion tip makes it possible to achieve an advantageous guidance of the transfer cannula as a whole, particularly in the course of the insertion process. For example, the coupling wall initially can place itself against the wall of the receptacle to be coupled such that an exact alignment, e.g. centering, of the tube section penetrating the closure element of this receptacle can at the same time be achieved, particularly prior to such a penetration, but furthermore also in the course of the penetration.

In addition, the tube sections, particularly their free ends, especially the insertion tip, also may be protected by the surrounding coupling wall in a non-usage position or in a preparatory position, respectively. In this way, the tube sections, particularly their free ends with the insertion tip, are protected from significant contamination or soiling prior to the use of the transfer cannula.

A V-shaped widening of the cutout in the direction of the terminal edge particularly may provide advantages in terms of handling, especially during a removal of a receptacle connected to the transfer cannula. With respect to an extending dimension in the circumferential direction of the coupling wall, the cutout may widen, for example, by approximately 1.2-times to 2.5-times, furthermore by approximately 1.5-times to 2-times, in the direction of the terminal edge. In addition, the V-shaped widening may approximately begin in the center of the longitudinal extent of the cutout viewed in the direction of the longitudinal extent of the tube sections, furthermore approximately in the region of a central third of the longitudinal extent. The section of the cutout extending in front thereof may viewed along the longitudinal extent have an essentially constant extending dimension in the circumferential direction.

In contrast to known solutions, an advantageous design of a transfer cannula, particularly in terms of its handling, is achieved due to the potential arrangement of two oppositely extending retaining walls with coupling walls retained thereon in a displaceable manner. Both ends of the transfer cannula viewed in the direction of the longitudinal extent of the tube sections may therefore be suitable for accommodating the first or the second receptacle. The respective procedure for coupling or also for decoupling the respective receptacle therefore may be identical on both sides.

The characteristics of the above-described independent claims respectively are important individually, as well as in any combination with one another, wherein characteristics of an independent claim furthermore can be combined with the characteristics of another independent claim or with characteristics of multiple independent claims, as well as with only individual characteristics of one or more of the other independent claims.

According to a potential embodiment, two retaining walls that extend in opposite directions starting from a central region may be provided and a coupling wall may be respectively retained on said retaining walls in a displaceable manner, wherein one or both coupling walls may protrude beyond the respective insertion tip in the direction of the longitudinal extent of the tube sections, and wherein a cutout, which may widen in a V-shaped manner at the terminal edge, may be provided in one or both coupling walls.

Other characteristics of the invention are frequently described below, as well as in the description of the figures, in their preferred association with the object of claim 1 and/or the other independent claim or with characteristics of other claims. However, they may also be important in association with only individual characteristics of claim 1 and/or the other independent claim or the respective other claim or independently.

According to another potential embodiment, the transfer cannula essentially may be realized mirror-symmetrical with respect to a central plane extending transverse to the longitudinal extent of the tube sections. This also results in an advantageous design in terms of handling. Both end regions of the transfer cannula can be used for selectively attaching the first receptacle and the second receptacle. A fixed assignment of the first and the second receptacle to an optionally predefined side of the transfer cannula therefore is not mandatory.

An extent of the cutout from the facing insertion tip up to the terminal edge of the coupling wall may correspond to one-third or more of a length of a tube section that is completely closed in the circumferential direction. Furthermore, this oversize of the cutout beyond the insertion tip viewed along the longitudinal extent of the tube sections may correspond to approximately 0.3-times to 0.7-times, furthermore to approximately 0.4-times to 0.6-times, the longitudinal extending dimension of a tube section, which is completely closed in the circumferential direction over this extending dimension.

In another embodiment, the tube sections may be surrounded by the first cylinder region for a closure region of a receptacle, wherein said first cylinder region forms a retaining wall, wherein the cutouts furthermore may be formed in a second cylinder region that is provided coaxial to the first cylinder region and forms the coupling wall, and wherein the second cylinder region may extend at a radial distance from the first cylinder region.

In this case, the two cylinder regions for forming the retaining wall and the coupling wall may be aligned coaxial to one another.

The two cylinder regions may also be realized integrally and uniformly in material with the tube sections, e.g. by being manufactured in a plastic injection moulding process.

The retaining wall formed by the first cylinder region preferably can serve for the retention of the transfer cannula as a whole on a closure region that comprises the closure means of the receptacle. In this case, the tube sections essentially may be provided centrally and oriented along a central longitudinal axis of the retaining wall.

The central plane extending transverse to the longitudinal extent of the tube sections may be constructively formed by a transverse wall, which accordingly extends transverse to the longitudinal extent and starting from which the tube sections, as well as the retaining and/or coupling walls, respectively extend in the longitudinal direction on both sides, wherein the tube sections as a whole extend through such a transverse wall.

The insertion tip of one tube section preferably can protrude beyond a terminal edge of the first cylinder region or the retaining wall, which preferably extends transverse to the longitudinal direction of the tube sections and is spaced apart from the central plane in the longitudinal direction. In this case, a corresponding protruding dimension of the insertion tip beyond the terminal edge of the retaining wall may correspond to half or less of the length of the tube section, which is completely closed in the circumferential direction.

With respect to a side view of the transfer cannula as a whole, an associated cutout of the coupling wall furthermore may end at a distance from the terminal edge of the retaining wall viewed along the longitudinal extent of the tube section.

In a potential embodiment, the first cylinder region forming the retaining wall may be designed in a circumferentially closed manner. In an alternative embodiment, this cylinder region may also be partially open in the circumferential direction and optionally even be open as far as the terminal edge.

Ribs extending in the direction of the tube sections may be formed on the other side of the second cylinder region that forms the coupling wall. These ribs can serve as a rolling protection in order to ensure that the transfer cannula does not roll off a table or the like during or after its use. In addition, the ribs can serve for improving the handling of the transfer cannula, particularly during a coupling of the receptacles and/or during a removal of the receptacles, e.g. after a transfer has been carried out.

If the coupling wall is displaceably retained on the retaining wall, it would furthermore be possible to realize a rotationally fixed guidance in this respect. In this case, the coupling wall accordingly can be displaced relative to the retaining wall in a sliding manner in the longitudinal direction of the tube sections, optionally and preferably such that its displacement is limited by a stop in both directions. With respect to the circumferential direction, however, the coupling wall may in such an embodiment be immovably captured on the retaining wall such that a predefined alignment in the circumferential direction can be realized in any displacement position of the coupling wall.

For example, the retaining wall may to this end have at least one longitudinal slot and a rib of the coupling wall, which is directed radially inward, may engage into said longitudinal slot.

Furthermore, a guidance of the coupling wall in the course of the sliding displacement preferably can also be realized due to the rib/longitudinal slot interaction.

In addition, multiple longitudinal slots may be provided over the circumference of the retaining wall, wherein said longitudinal slots may be uniformly distributed relative to one another in the circumferential direction, optionally within a group. According to another potential embodiment, it would be possible to provide two groups of two, three or more longitudinal slots, which in a cross section lie diametrically opposite of one another, wherein the longitudinal slots of a group may be uniformly spaced apart from one another in the circumferential direction.

Ribs that extend in the longitudinal direction of the tube sections and protrude radially outward may be integrally formed along the outer edges of a longitudinal slot of the retaining wall, wherein the inner side of the coupling wall can be supported on said ribs. A uniform radial spacing between the coupling wall and the retaining wall can be achieved by arranging multiple ribs of this type over the circumference of the retaining wall.

A radially extending projection may be formed on the retaining wall in the central region with respect to a longitudinal extent of the tube sections, wherein a displaceable coupling wall can abut on said projection in the retracted state. In a potential embodiment, a central plane of this radially extending projection, which extends transverse to the longitudinal extent of the tube sections, may form a central plane or plane of symmetry, from which a retaining wall and/or coupling wall may respectively extend on both sides.

In addition, a radial dimension of the radially extending projection starting from a central longitudinal axis of the transfer cannula may exceed the corresponding greatest radial dimension of the coupling wall.

Furthermore, this rib and/or each coupling wall may be designed non-circular viewed over the circumference, e.g. by being provided with diametrically opposite flat sections. The thusly designed transfer cannula is thereby provided with rolling protection.

With respect to the disclosure, the ranges or value ranges or multiple ranges indicated above and below also include all intermediate values, particularly in 1/10 increments of the respective dimension, but optionally also dimensionless. For example, the indication 0.3-times to 0.7-times also includes the disclosure of 0.31-times to 0.7 times, 0.3-times to 0.69-times, 0.31-times to 0.69-times, etc., and the indication of 1.2-times to 2.5-times also includes the disclosure of 1.3-times to 2.5-times, 1.2-times to 2.4-times, 1.3-times to 2.4-times, etc. The respective disclosure may on the one hand serve for defining a lower and/or upper limit of a cited range, but alternatively or additionally also for disclosing one or more singular values from a respectively indicated range.

BRIEF DESCRIPTION OF THE DRAWINGS

The invention is described in greater detail below with reference to the attached drawings that, however, merely show exemplary embodiments. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
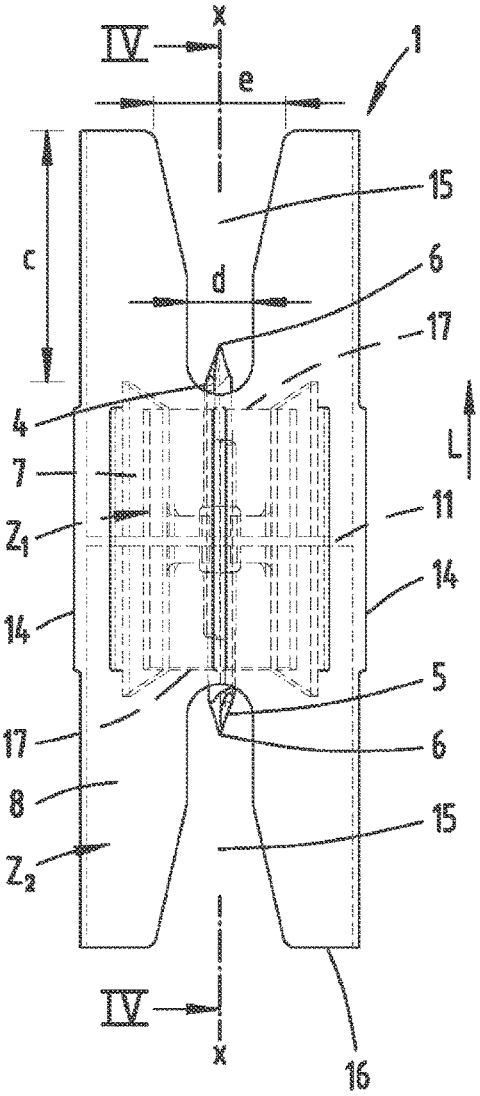
FIG. 1 shows a transfer cannula according to a first embodiment in the form of a side view.

A transfer cannula 1 for the sterile transfer, e.g., of fluids to powders or fluids to fluids from a first receptacle 2 into a second receptacle 3 is described below with reference to a first embodiment illustrated in FIGS. 1 to 5 and with reference to a second embodiment illustrated in FIGS. 6 to 17.

The transfer cannula 1 has two parallel tube sections 4, 5, wherein each tube section 4, 5 respectively forms an insertion tip 6 on one end.

A central longitudinal axis x of the transfer cannula 1 extends in the longitudinal direction L of the tube sections 4 and 5. A first cylinder region $Z_1$ surrounds the tube sections 4 and 5 essentially concentric to this central longitudinal axis x and at a radial distance from said tube sections, wherein this first cylinder region $Z_1$ forms a retaining wall 7 for a closure region 9 of the respective receptacle 2 or 3. Furthermore, a second cylinder region $Z_2$ that forms a coupling wall 8 is provided coaxial to the central longitudinal axis x and at a radial distance from the first cylinder region $Z_1$. The respective receptacle wall 10 may be encompassed by or supported on this coupling wall 8 in the corresponding associated position, particularly in the course of the transfer, e.g., of a fluid from the first receptacle 2 into the second receptacle 3 or vice versa.

Figure 2:
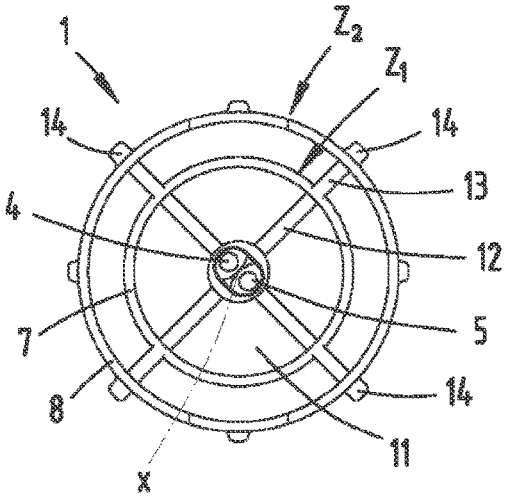
FIG. 2 shows a top view of the transfer cannula.
Figure 3:
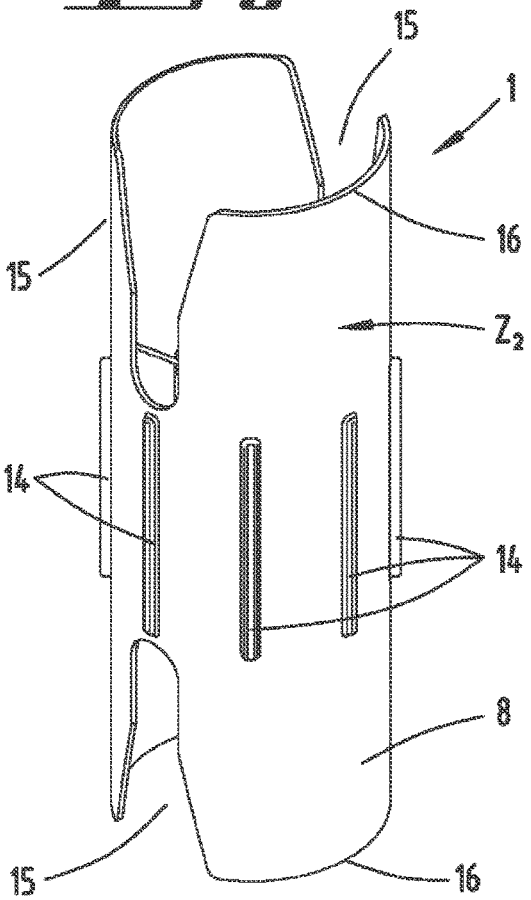
FIG. 3 shows the transfer cannula in the form of a perspective view.
Figure 5:
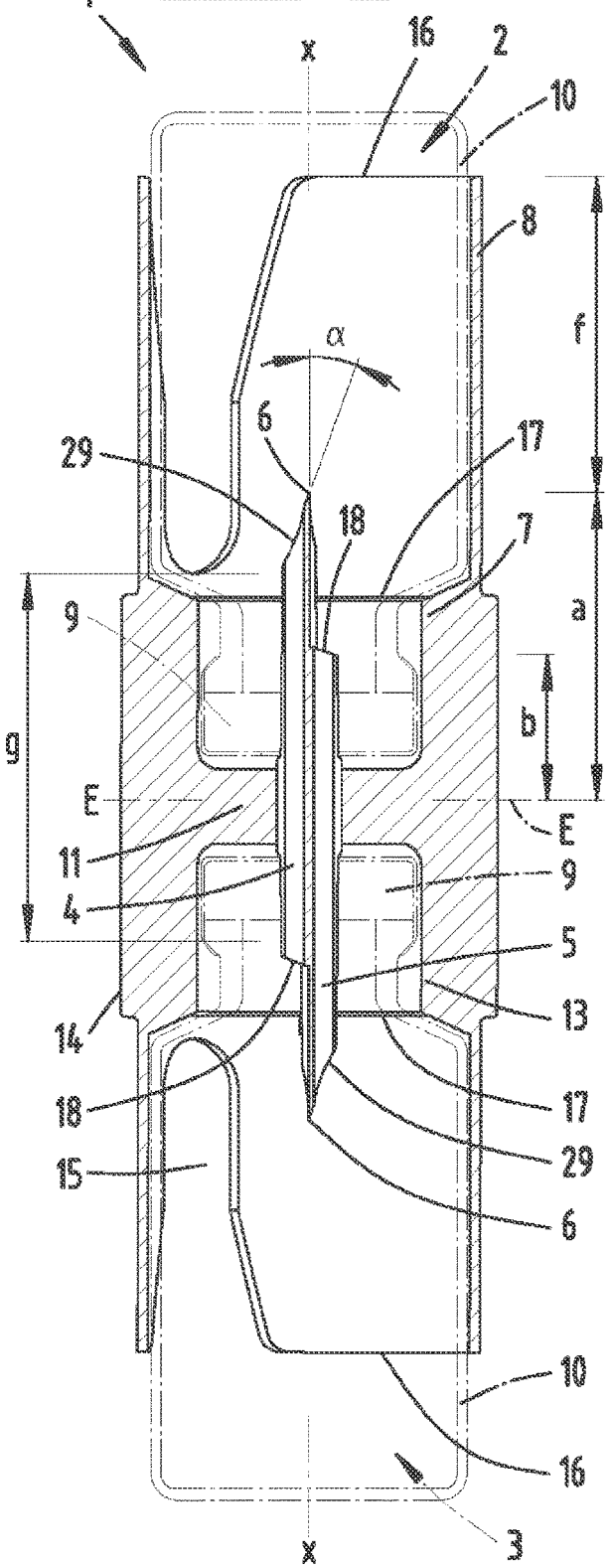
FIG. 5 shows another longitudinal section through the transfer cannula along a plane of section that differs from the section in FIG. 4.
Figure 6:
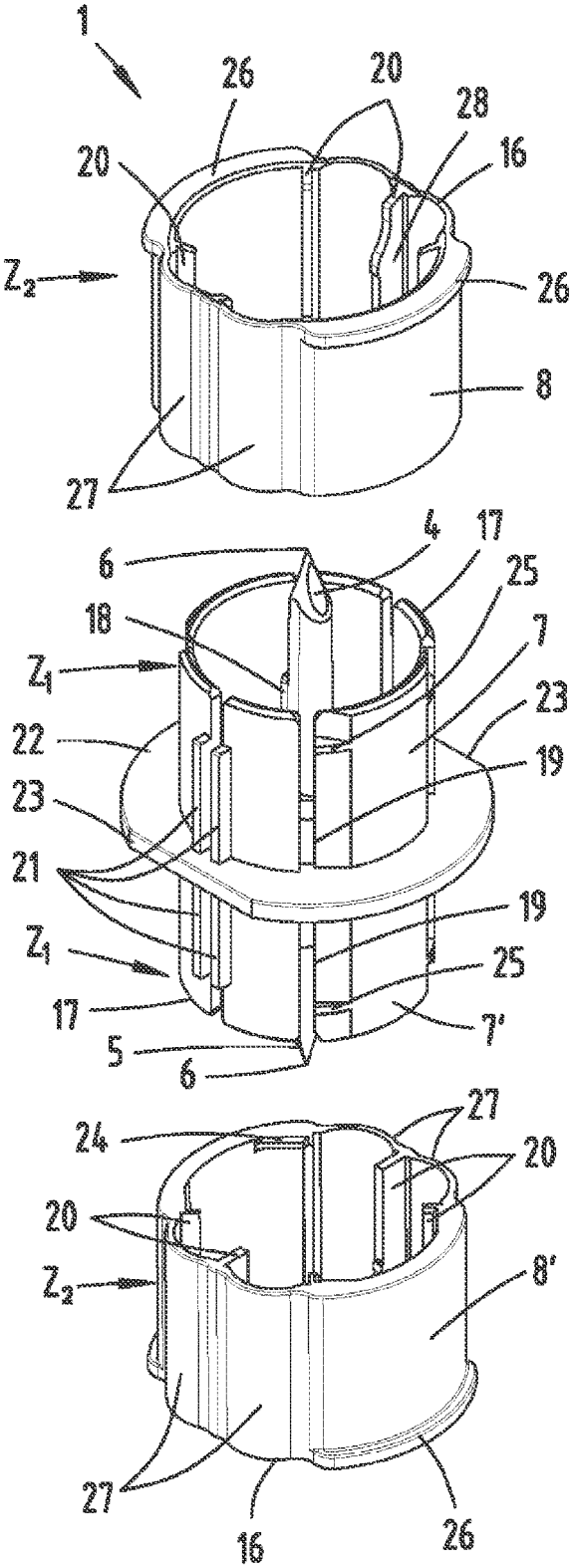
FIG. 6 shows a perspective exploded view of a transfer cannula according to a second embodiment.
Figure 7:
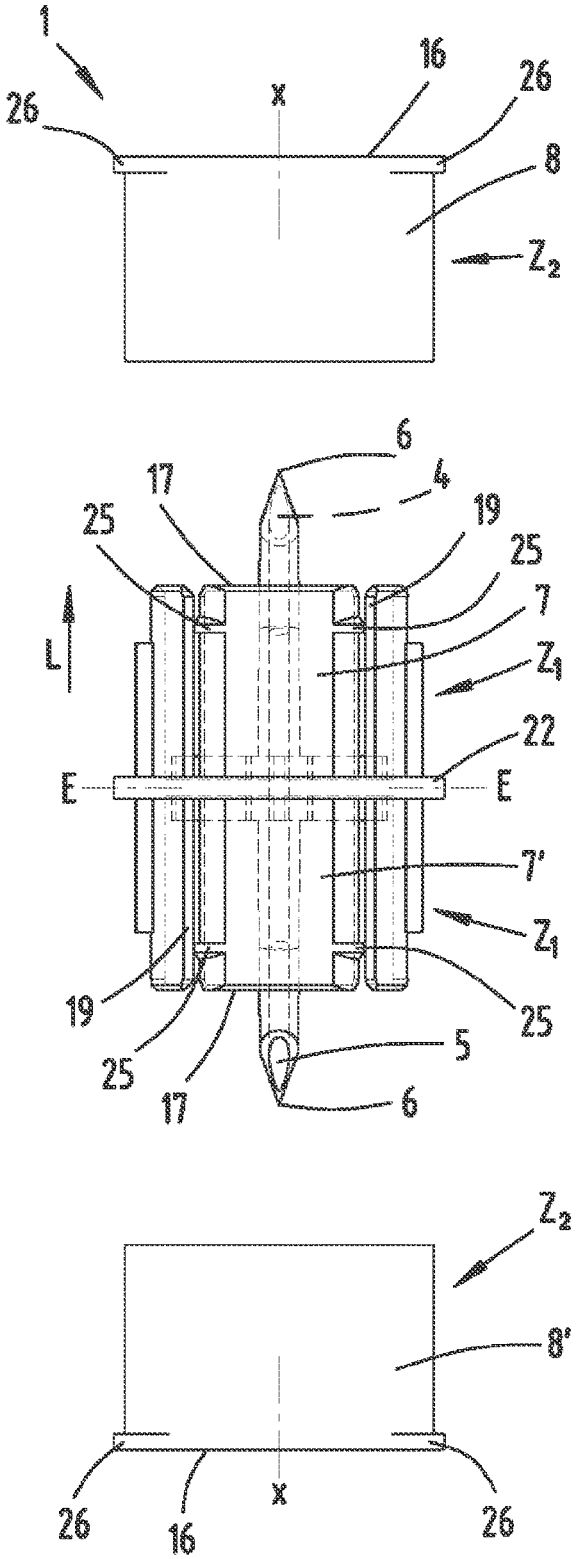
FIG. 7 shows a corresponding side view.
Figure 8:
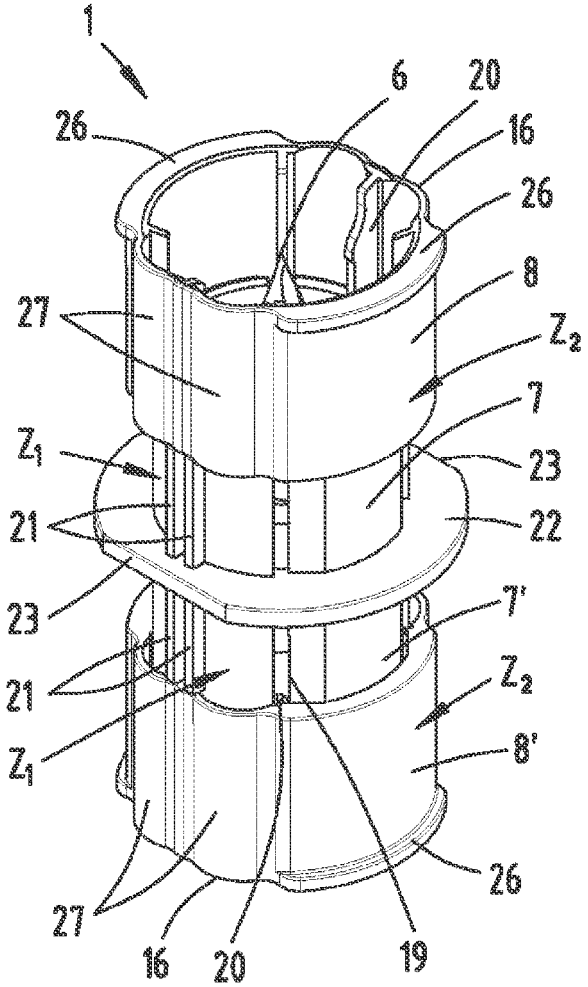
FIG. 8 shows a perspective view of the transfer cannula according to the second embodiment in a pulled-apart initial position.
Figure 9:
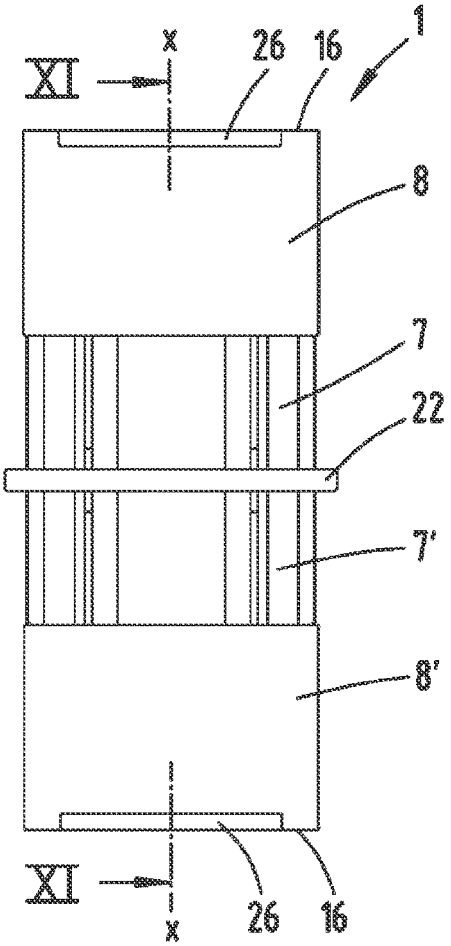
FIG. 9 shows a corresponding side view.

The two tube sections 4 and 5, preferably extend in an essentially tubular manner and are arranged adjacent to one another such that the central longitudinal axis x may extend between the tube sections 4 and 5 in the region of the tangentially contacting tube walls (compare particularly to FIGS. 2 and 5, as well as 10 and 11).

The tube sections 4 and 5 extend in the longitudinal direction L with different lengths a and b starting from a transverse plane E, which is aligned transverse to the central longitudinal axis x and at the same time may also represent a central plane or plane of symmetry. For example, the tube section having the insertion tip 6 on its end in this extending direction may extend over a length a that corresponds to approximately 1.5-times to 2.5-times, furthermore to approximately 2-times, the length b of the other tube section as shown. In comparison with the insertion tip 6, this other tube section with the shorter length b ends in this longitudinal direction in a rather stub-like manner and accordingly has a wall, which in a cross section transverse to the central longitudinal axis x at least approximately extends circumferentially in the opening plane.

In contrast, the insertion tip 6 has an opening area 29 that includes an acute angle $\alpha$ of approximately 10 to 20 degrees, furthermore approximately 15 degrees, with a line extending parallel to the central longitudinal axis x.

In a mirror-symmetrical arrangement to the transverse plane E, the tube section provided with the insertion tip 6 on one end terminates in a stub opening on the other end whereas the tube section provided with the stub opening is designed longer beyond the transverse plane E and forms an insertion tip 6 on the other end.

A transverse wall 11 may be provided along the transverse plane E or accordingly along a plane of symmetry. This transverse wall carries the cannula unit formed by the tube sections 4 and 5 and essentially is penetrated centrally by these tube sections.

Furthermore, the retaining wall 7 may also be connected to this transverse wall 11. In this case, the retaining wall 7 may extend in the axial direction on both sides starting from the transverse wall 11 or the transverse plane E, respectively, wherein an additional connection and stabilization may be realized by means of radial ribs 12. These radial ribs 12 preferably can be uniformly distributed over the circumference with respect to the central longitudinal axis x. For example, four such radial ribs 12 may be provided in accordance with the first exemplary embodiment illustrated in FIGS. 1 to 5 or six radial ribs may be alternatively provided in accordance with the second exemplary embodiment (compare to FIG. 10).

In this case, the radial ribs 12 preferably can be connected to the transverse wall 11, as well as to the inner wall surface of the retaining wall 7. A symmetrical arrangement with respect to the transverse plane E may also be realized with regard to the arrangement and design of the radial ribs 12.

According to the first exemplary embodiment illustrated in FIGS. 1 to 5, the retaining wall 7 may be designed in a circumferentially closed manner, particularly in the form of a circular cylinder.

The coupling wall 8 may be respectively connected to this first cylinder region $Z_1$ or this retaining wall 7 at a radial distance toward the outside, wherein spacer-like radial ribs 13 are arranged between the retaining wall 7 and the coupling wall 8. These additional radial ribs 13 may be provided between the tube sections 4, 5 and the retaining wall 7 in radial extension of the above-described radial ribs 12.

The coupling wall 8 preferably can have an essentially circular-cylindrical shape and be provided with ribs 14 extending in the longitudinal direction L, wherein said ribs are viewed in the longitudinal direction L arranged centrally on the outer side of the coupling wall and intended to serve as rolling protection prior to, during or after the use of the transfer cannula 1. In addition, these ribs 14 also improve the handling of the thusly designed transfer cannula 1.

Furthermore, the coupling wall 8 preferably can also be provided with cutouts 15, which essentially extend in the longitudinal direction L, on both sides of the transverse plane E. These cutouts may have the shape of oblong holes and respectively open toward the free terminal edge 16. With respect to a top view according to FIG. 2, a diametrically opposite arrangement of two cutouts 15 respectively is provided on both sides of the transverse plane E.

The illustration in FIG. 1, in particular, furthermore shows that a V-shaped widening in the direction of the terminal edge 16 may be formed over the length c of each cutout 15 viewed in the longitudinal direction L, namely starting at approximately half the extending length. With respect to a side view according to FIG. 1, the end region of the cutout 15 facing the transverse plane E may have a width d that corresponds to approximately 3-times to 5-times, e.g. to approximately 4-times, a clear inside diameter of a tube section 4, 5.

In the same side view according to FIG. 1, the width e of the cutout 15 in the runout in the region of the terminal edge 16 may correspond to approximately 1.5-times to 2.5-times, furthermore to approximately 2-times, the width d. With respect to a side view of the transfer cannula 1, e.g. according to FIG. 1, the cutout 15 may initially extend with a constant width d starting from the end facing the transverse plane E and then transform into a section that uniformly widens as far as into the terminal edge 16, e.g. in an approximately V-shaped manner.

Figure 4:
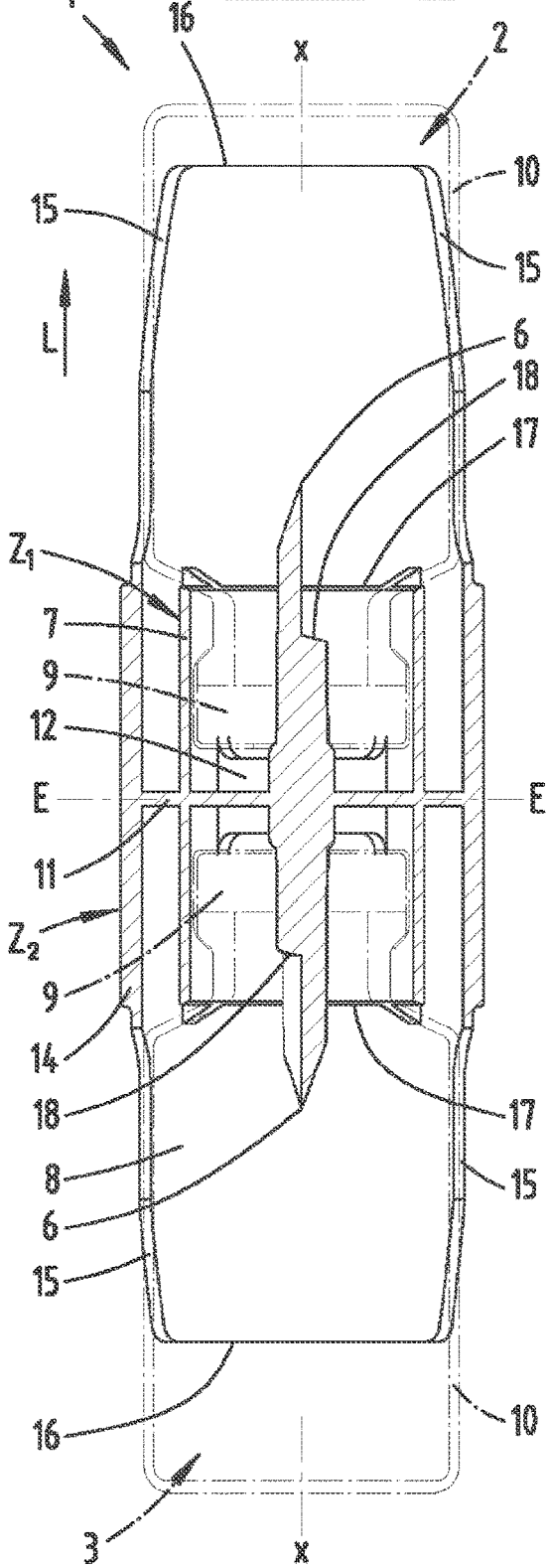
FIG. 4 shows a longitudinal section along the line IV-IV in FIG. 1.

The above-described length c of the cutout 15 starting from the terminal edge 16 furthermore may be dimensioned such that the insertion tip 6 of a respective tube section 4 or 5 may with respect to a side view according to FIG. 1 be exposed in the cutout 15, e.g. as also illustrated in FIG. 4.

Accordingly, the insertion tip 6 preferably can protrude beyond the corresponding terminal edge 17 of the retaining wall 7 whereas the stub 18 of the respective other (shorter) tube section 5 or 4 can according to a preferred embodiment end at an axial distance from this terminal edge 17 of the retaining wall 7 and accordingly extend within the pot-shaped opening formed by the retaining wall 7.

The sectional view in FIG. 5, in particular, furthermore shows that a length f from the terminal edge 16 of the coupling wall 8 to a plane that is aligned transverse to the longitudinal axis x and contacts the insertion tip 6 may correspond to approximately 0.8-times to 1.2-times a length g of a tube section 4, 5, which in a cross section transverse to the longitudinal axis x is circumferentially closed over the length g.

According to the first exemplary embodiment, the tube sections 4, 5, the retaining wall 7 and the coupling wall 8 preferably can be realized integrally and uniformly in material together with the described ribs, e.g. as a result of being manufactured in a plastic injection moulding process.

In the second exemplary embodiment illustrated in FIGS. 6 to 17, in contrast, only the tube sections 4, 5 and the retaining walls 7, 7', which in this case are also connected by means of radial ribs 12, are realized integrally and uniformly in material.

In this embodiment, two retaining walls 7, 7', to which a coupling wall 8 or 8' is respectively assigned, extend essentially symmetrical to the transverse plane E.

The coupling walls 8, 8' are guided on the respective retaining wall 7, 7' such that they can be displaced relative thereto in the longitudinal direction L, but in a rotationally fixed manner.

To this end, the retaining walls 7, 7' may have longitudinal slots 19 that extend in the longitudinal direction L and according to the exemplary embodiment shown may completely penetrate the respective retaining walls 7 and 7' in the radial direction.

The respective longitudinal slots 19 extend in the longitudinal direction L in an open-edged manner from the transverse wall 11 as far as into the terminal edge 17 of the retaining wall 7, 7'.

Figure 17:
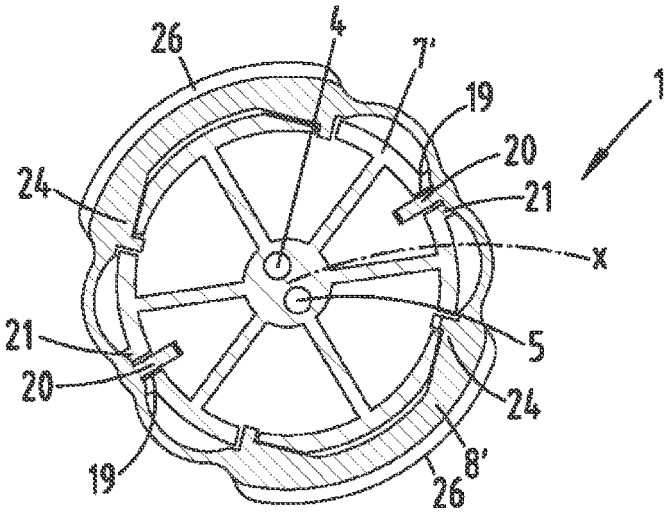
FIG. 17 shows a section along the line XVII-XVII in FIG. 16.

The sectional view in FIG. 17, in particular, furthermore shows that it would essentially be possible to provide two groups of longitudinal slots 19, wherein said groups essentially may lie diametrically opposite of one another with respect to the central longitudinal axis x. For example, each group may comprise three such longitudinal slots 19, which preferably are uniformly spaced apart from one another in the circumferential direction. The circumferential spacing between two circumferentially successive longitudinal slots 19 of different groups may be chosen greater than the circumferential spacing between two longitudinal slots 19 of the same group.

Ribs 20 of the respective coupling wall 8 or 8', which are directed radially inward, engage into the longitudinal slots 19 (compare to FIG. 17).

This rib/slot arrangement allows a rotationally fixed sliding displaceability of the respective coupling walls 8 and 8' relative to the retaining wall 7, 7' or the tube sections 4, 5, respectively.

Furthermore, spacer ribs 21 may be integrally formed on the outer side of the retaining wall 7, 7' such that they respectively flank a longitudinal slot 19, wherein said spacer ribs ensure a uniform radial spacing between the coupling wall 8, 8' and the retaining wall 7, 7'.

The sliding displaceability of the coupling wall 8, 8' relative to the retaining wall 7, 7' preferably is limited by a stop in both directions of displacement.

Each coupling wall 8, 8' may form two spring sections 27 that lie diametrically opposite of one another in the circumferential direction. The rib 20 assigned to each spring section 27 on the inner side serves as a spreader 28, by means of which the respective spring section 27 can be displaced radially outward in an elastically resilient manner during an attachment of a receptacle 2, 3. In this way, the spring sections 27 can act upon the receptacle 2, 3, e.g. upon its receptacle wall 10, in a clamping manner by means of the spreaders 28.

The transverse wall 11 is extended radially outward in order to form an abutment for the coupling walls 8, 8' in the direction, in which they face one another (retracted state). The thusly formed essentially circumferential projection 22 may protrude beyond the coupling wall 8, 8' in the radial direction as shown (compare also, for example, to FIG. 15).

The transfer cannula 1 can be secured against rolling, e.g. while lying on a table surface or the like, by providing diametrically opposite straight sections 23 that interrupt the otherwise circular outline of the projection 22.

Figure 12:
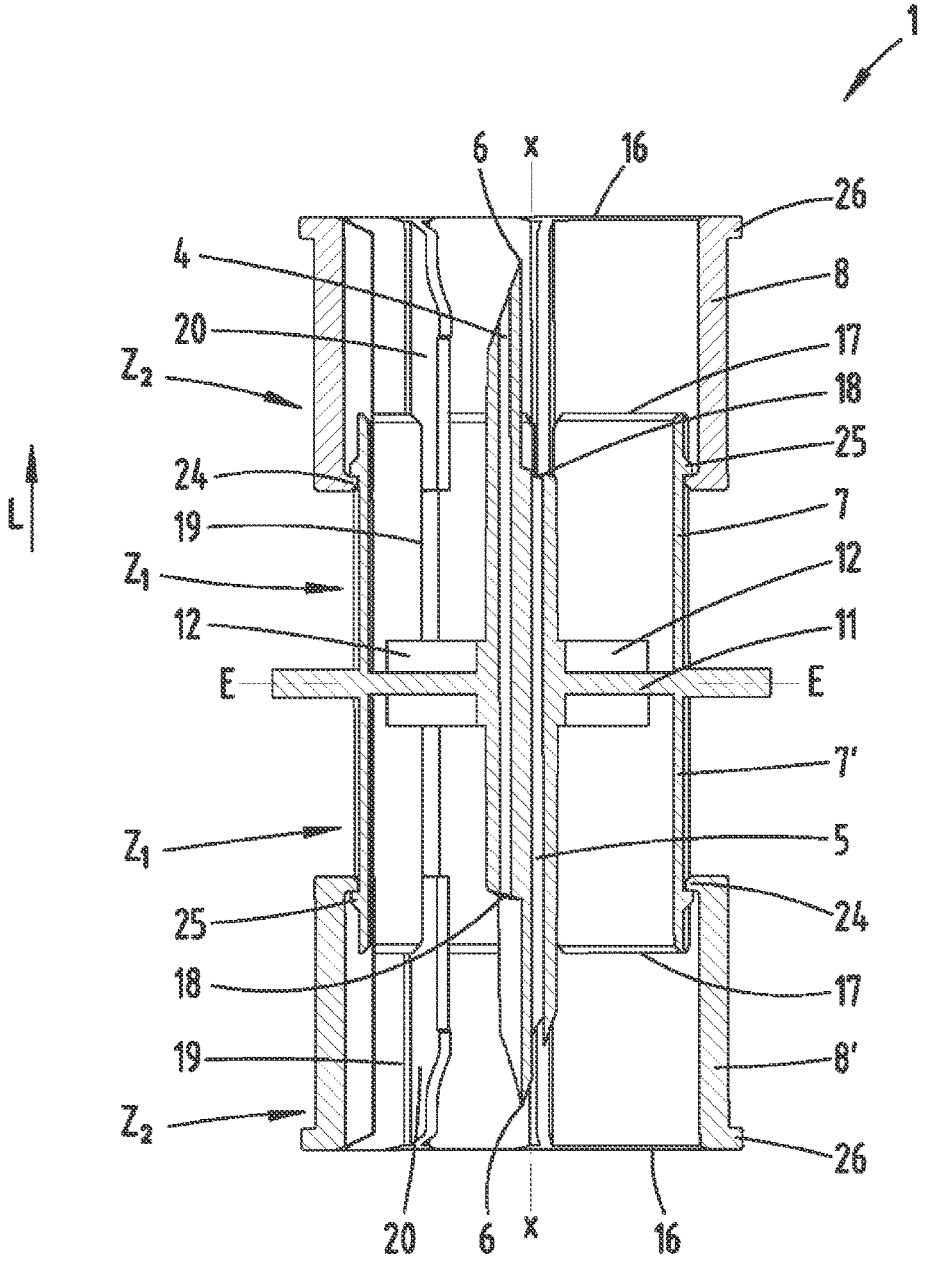
FIG. 12 shows another longitudinal section through the transfer cannula along a different plane of section than in the FIG. 11.
Figure 13:
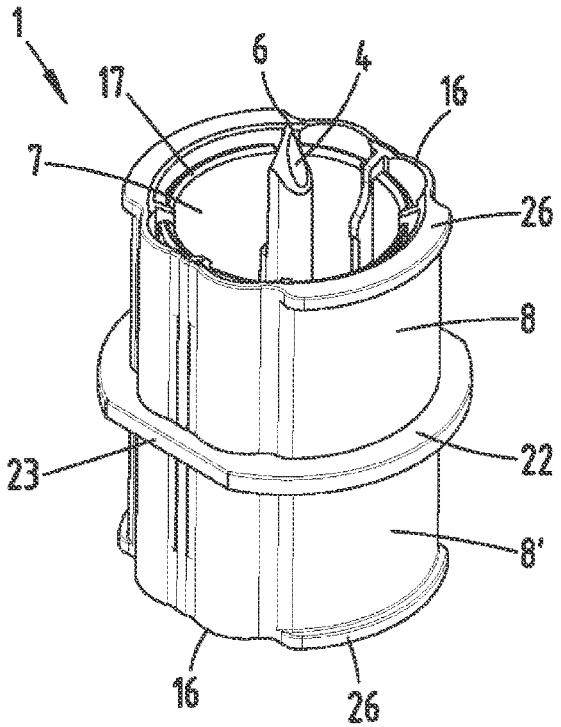
FIG. 13 shows a perspective view that corresponds to FIG. 8, but concerns a pushed-together usage position of the transfer cannula.
Figure 14:
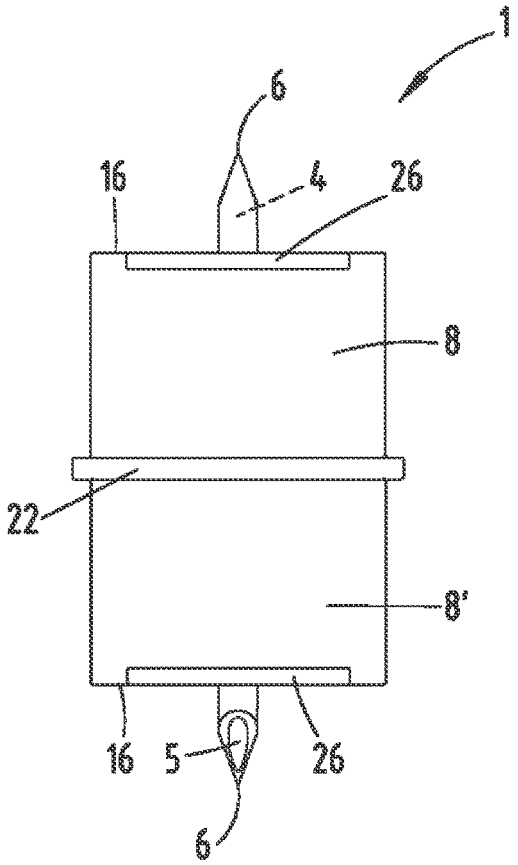
FIG. 14 shows a corresponding side view.

A stop limitation in the extending direction of the coupling walls 8 and 8' is realized as a result of the abutment of stop ribs 24 provided on the inner side of the coupling wall 8, 8' on counter-stop ribs 25 formed on the outer side of the retaining wall 7, 7' (compare to FIG. 12).

Figure 10:
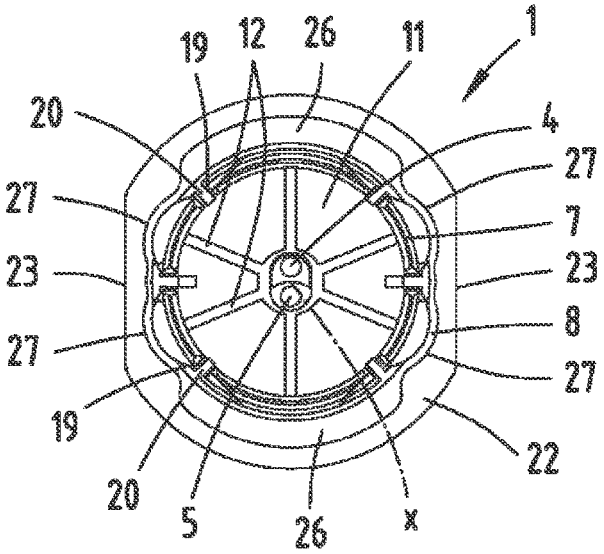
FIG. 10 shows a top view of the transfer cannula.
Figure 11:
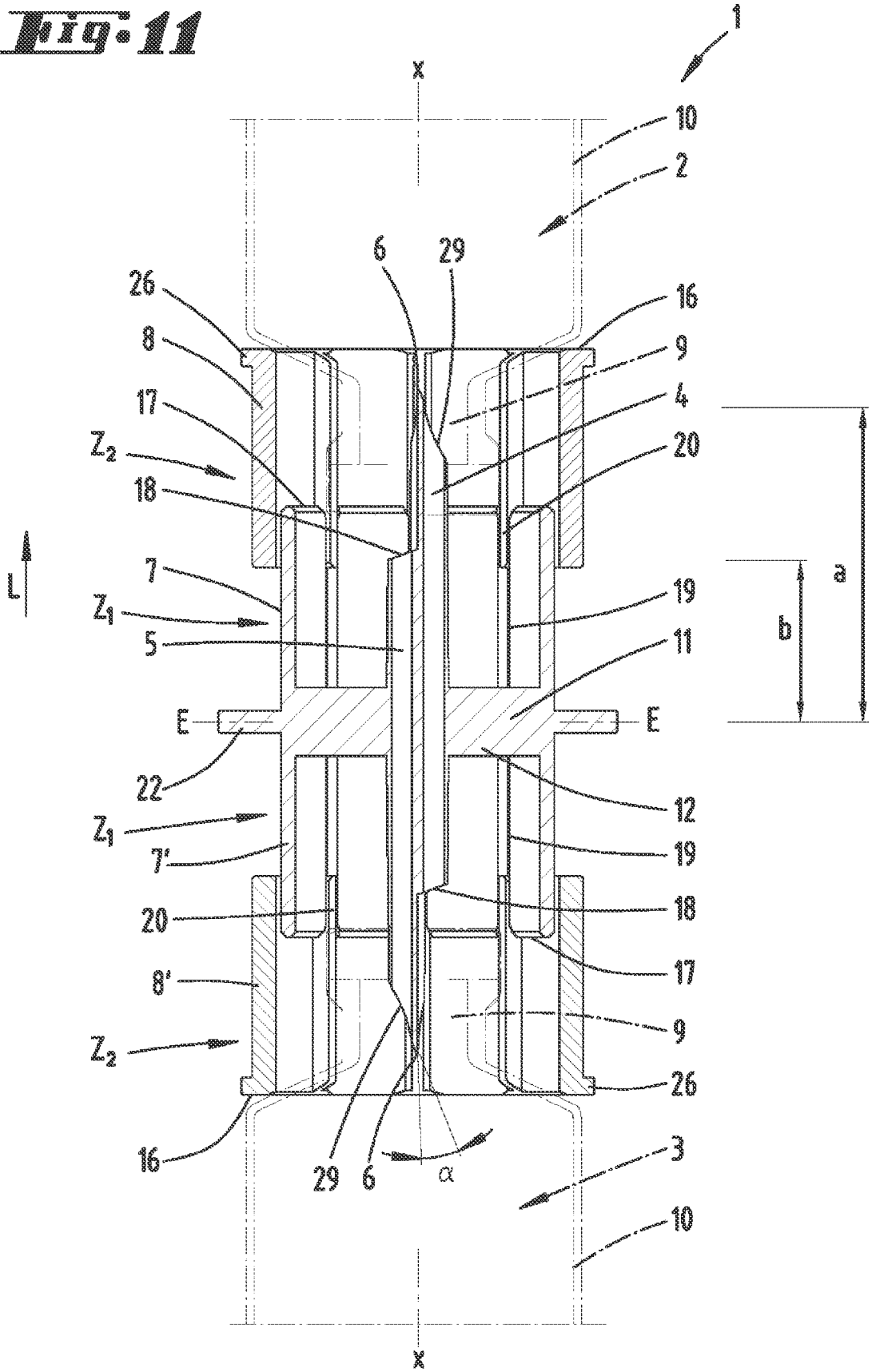
FIG. 11 shows a longitudinal section through the transfer cannula along the line XI-XI in FIG. 9.

With respect to a top view according to FIG. 10, radially protruding collar sections 26 may be integrally formed on the outer side of the coupling walls 8, 8' in the region of their terminal edges 16 such that they are offset relative to the straight sections 23 of the projection 22 by 90 degrees. These collar sections 26 may serve as a retraction aid.

Regardless of its design, the transfer cannula 1 preferably can be stored in a sterile film pouch or the like prior to its first use. After the removal from the film pouch, the receptacles 2 and 3 can be attached on both sides in such a way that the free ends of the tube sections 4 and 5 penetrate the closure region 9 consisting, for example, of a rubber material with the aid of the insertion tip 6 such that the openings in the region of the insertion tip 6 and in the region of the stub 18 and therefore the openings of both tube sections 4, 5 can freely protrude into the receptacle interior (compare to FIGS. 5 and 15).

The coupling wall 8, 8' optionally surrounds the receptacle wall 10 in a protective manner, but in any case such that the arrangement is centered.

In a displaceable arrangement of the coupling walls 8, 8', the transfer cannula 1 initially can be attached to a receptacle 3 in the extended position, i.e. in the pulled-apart position, whereupon a receptacle 2 is attached to the opposite end of the tube sections 4 and 5 from above. The coupling walls 8 and 8', which were previously displaced into a telescopic position, guide the receptacles 2 and 3 in the course of a straining downward motion of the upper (first) receptacle 2 such that its closure region 9 is penetrated by the facing insertion tip 8, the retaining wall 7, 7' is likewise displaced downward together with the projection 22 and the insertion tip 6 directed at the lower (second) receptacle 3 is pressed through the associated closure region 9.

Figure 15:
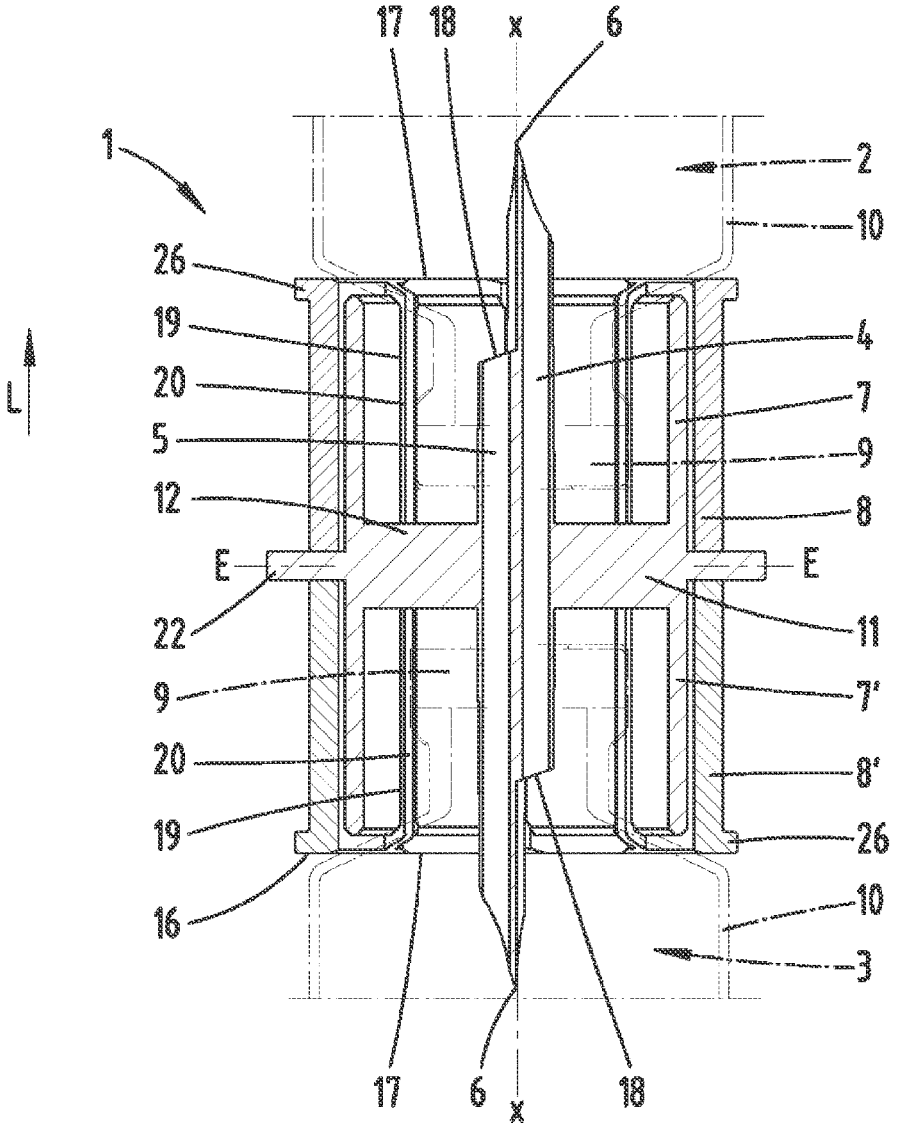
FIG. 15 shows a longitudinal section that corresponds to FIG. 11, but concerns the usage position according to FIG. 13.
Figure 16:
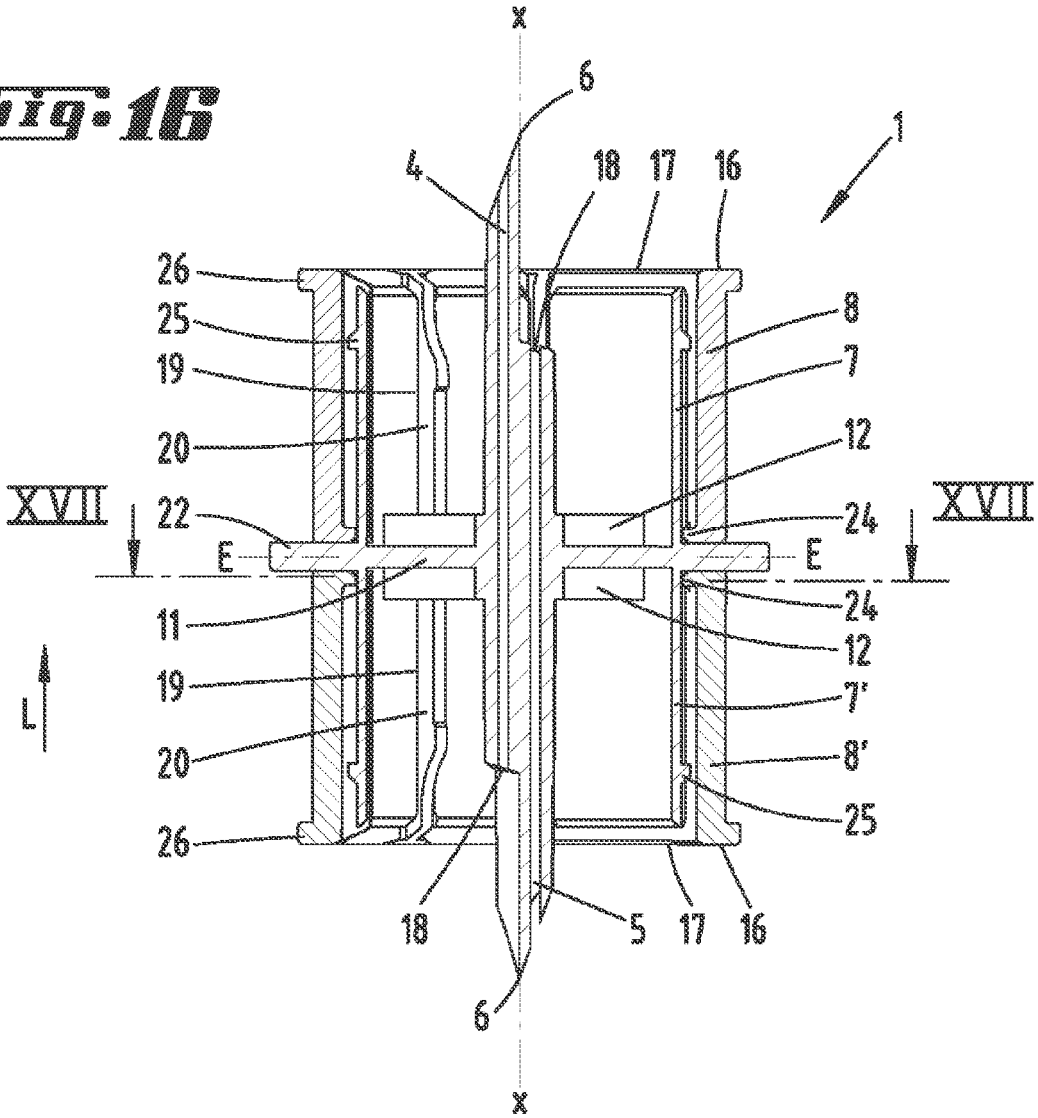
FIG. 16 shows a longitudinal section that corresponds to FIG. 12, but concerns the usage position according to FIG. 13.

Since the retaining wall 7, 7' and the coupling walls 8, 8' are in this case telescopically pushed into one another, a sealing transfer position is achieved, in which the insertion tips 6 also protrude beyond the planes of the terminal edges 16 of the coupling walls 8 and 8' (compare to FIG. 15).

In the course of the transfer, e.g. of fluid, from the first (upper) receptacle 2 into the second (lower) receptacle 3, a fluid transport is achieved by means of one of the tube sections 4 or 5 whereas a ventilation or aeration is achieved by means of the other tube section 5, 4.

The preceding explanations serve for elucidating all inventions that are included in this application and respectively enhance the prior art independently with at least the following combinations of characteristics, wherein two, multiple or all of these combinations of characteristics may also be combined with one another, namely:

A transfer cannula, which is characterized in that the coupling wall 8 protrudes beyond the insertion tip 6 in the direction of the longitudinal extent L of the tube sections 4, 5, and in that the cutout 15 widens in a V-shaped manner at the terminal edge 16.

A transfer cannula, which is characterized in that the transfer cannula 1 is realized mirror-symmetrical with respect to a central plane extending transverse to the longitudinal extent L of the tube sections 4, 5.

A transfer cannula, which is characterized in that an extent of the cutout 15 from the respective insertion tip 6 up to the terminal edge 16 of the coupling wall 8 corresponds to one-third or more of a length g of a circumferentially closed tube section 4, 5.

A transfer cannula, which is characterized in that the tube sections 4, 5 are surrounded by a first cylinder region $Z_1$ for a closure region 9 of a receptacle 2, 3, wherein said first cylinder region forms a retaining wall 7, and in that the cutouts 15 are formed in a second cylinder region $Z_2$ that is provided coaxial to the first cylinder region $Z_1$ and forms the coupling wall 8, wherein said second cylinder region extends at a radial distance from the first cylinder region $Z_1$.

A transfer cannula, which is characterized in that the insertion tip 6 protrudes beyond a terminal edge 17 of the first cylinder region $Z_1$, which extends transverse to the longitudinal direction L of the tube sections 4, 5.

A transfer cannula, which is characterized in that the first cylinder region $Z_1$ is realized in a circumferentially closed manner.

A transfer cannula, which is characterized in that ribs 14 extending in the longitudinal direction L of the tube sections 4, 5 are formed on the outer side of the second cylinder region $Z_2$.

A transfer cannula, which is characterized in that two oppositely extending retaining walls 7, 7' are provided starting from a central region with respect to a longitudinal extent L of the tube sections 4, 5, wherein a coupling wall 8, 8' respectively is retained on said retaining walls in a displaceable manner.

A transfer cannula, which is characterized in that the coupling wall 8, 8' is guided on the retaining wall 7, 7' in a rotationally fixed manner.

A transfer cannula, which is characterized in that the retaining wall 8, 8' has a longitudinal slot 19, wherein a rib 20 of the coupling wall 8, 8', which is directed radially inward, engages into said longitudinal slot.

A transfer cannula, which is characterized in that a radially extending projection 22 is formed on the retaining wall 7, 7' in the central region with respect to a longitudinal extent L of the tube sections 4, 5, wherein a coupling wall 8, 8' can abut on said projection in the retracted state.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

LIST OF REFERENCE SYMBOLS

1 Transfer cannula
2 First receptacle
3 Second receptacle
4 Tube section
5 Tube section
6 Insertion tip
7 Retaining wall
7' Retaining wall
8 Coupling wall
8' Coupling wall
9 Closure region
10 Receptacle wall
11 Transverse wall
12 Radial rib
13 Radial rib
14 Rib
15 Cutout
16 Terminal edge
17 Terminal edge
18 Stub
19 Longitudinal slot
20 Rib
21 Spacer rib
22 Projection
23 Straight section
24 Stop rib
25 Counter-stop rib
26 Collar section
27 Spring section
28 Spreader
29 Opening area
a Length
b Length
c Length
d Width
e Width
f Length
g Length
x Central longitudinal axis
E Transverse plane
L Longitudinal direction
$Z_1$ First cylinder region
$Z_2$ Second cylinder region
α Angle

The invention claimed is:

1. A transfer cannula (1) for sterile transfer of fluids to powders or fluids to fluids from a first receptacle (2) into a second receptacle (3), wherein said transfer cannula comprises two parallel tube sections (4, 5) that extend with different lengths in a longitudinal direction (L) of the tube sections (4, 5) starting from a transverse plane E, which is aligned transverse to a central longitudinal axis (x), wherein each of the tube sections has an insertion tip (6) at an end of each tube section that extends a greater distance from the transverse plane E than an opposite end of the respective tube section, wherein the tube sections (4, 5) are designed to be rigidly connected to a coupling wall (8) surrounding the tube sections (4, 5) in a cylindrical manner, wherein the coupling wall (8) has, associated with each insertion tip (6) and arranged oppositely on both sides with respect to the longitudinal direction (L) of the tube sections (4, 5), a cutout (15) that extends as far as a terminal edge (16) of the coupling wall (8) wherein each insertion tip (6) of the tube sections (4, 5) is in a side view exposed in a respective one of said cutouts, wherein the coupling wall (8) protrudes beyond the insertion tips (6) in the direction of the longitudinal extent (L) of the tube sections (4, 5), and wherein the cutout (15) widens in a V-shaped manner at the terminal edge (16).

2. The transfer cannula according to claim 1, wherein the transfer cannula (1) is point symmetric with respect to a central point on the transverse plane E.

3. The transfer cannula according to claim 1, wherein an extent of the cutout (15) from the respective insertion tip (6) up to a terminal edge (16) of the coupling wall (8) corresponds to one-third or more of a length (g) of a circumferentially closed tube section (4, 5).

4. A transfer cannula (1) for sterile transfer of fluids to powders or fluids to fluids from a first receptacle (2) into a second receptacle (3), wherein said transfer cannula comprises two parallel tube sections (4, 5) that have different lengths in a longitudinal direction (L) of the tube sections (4, 5), wherein each tube section (4, 5) terminates in an insertion tip (6), wherein the tube sections (4, 5) are designed to be rigidly connected to a coupling wall (8) surrounding the tube sections (4, 5) in a cylindrical manner, wherein the coupling wall (8) has, associated with each insertion tip (6) and arranged oppositely on both sides with respect to the longitudinal direction (L) of the tube sections (4, 5), a cutout (15) that extends as far as a terminal edge (16) of the coupling wall (8) wherein the insertion tip (6) of each of the tube sections (4, 5) is in a side view respectively exposed in said cutout, wherein each coupling wall (8) protrudes beyond the respective insertion tip (6) in the direction of the longitudinal extent (L) of the tube sections (4, 5), wherein the cutout (15) widens in a V-shaped manner at the terminal edge (16), wherein the tube sections (4, 5) are surrounded by a first cylinder region ($Z_1$) for a closure region (9) of a receptacle (2, 3), wherein said first cylinder region forms a retaining wall (7), and wherein the cutouts (15) are formed in a second cylinder region ($Z_2$) that is provided coaxial to the first cylinder region ($Z_1$) and forms the coupling wall (8), wherein said second cylinder region extends at a radial distance from the first cylinder region ($Z_1$).

5. The transfer cannula according to claim 4, wherein the insertion tip (6) protrudes beyond a terminal edge (17) of the first cylinder region ($Z_1$), which extends transverse to the longitudinal direction (L) of the tube sections (4, 5).

6. The transfer cannula according to claim 4, wherein the first cylinder region ($Z_1$) is realized in a circumferentially closed manner.

7. The transfer cannula according to claim 4, wherein ribs (14) extending in the longitudinal direction (L) of the tube sections (4, 5) are formed on the outer side of the second cylinder region ($Z_2$).

8. A transfer cannula (1) for sterile transfer of fluids to powders or fluids to fluids from a first receptacle (2) into a second receptacle (3), wherein said transfer cannula comprises two parallel tube sections (4, 5) that have different lengths in the longitudinal direction (L) of the tube sections (4, 5), wherein the longer tube section (4, 5) terminates in an insertion tip (6), wherein two oppositely extending retaining walls (7, 7') are provided starting from a central region with respect to a longitudinal extent (L) of the tube sections (4, 5), wherein coupling walls (8, 8') that each extend radially outside of a respective one of the retaining walls and surround the tube sections are retained on said retaining walls so as to be displaceable in a longitudinal direction (L) of the tube sections, wherein each retaining wall (7,7') has a longitudinal slot (19), wherein a rib (20) of the associated coupling wall (8, 8'), which is directed radially inward, engages into said longitudinal slot.

9. The transfer cannula according to claim 8, wherein the each of the coupling wall (8, 8') is guided on the retaining wall (7, 7') in a rotationally fixed manner.

10. The transfer cannula according to claim 8, wherein a radially extending projection (22) is formed on the retaining walls (7, 7') in a central region with respect to a longitudinal extent (L) of the tube sections (4, 5), wherein the coupling walls (8, 8') can abut on said projection in the retracted state.

* * * * *